US012807365B2

(12) United States Patent
Nordgren

(10) Patent No.: US 12,807,365 B2
(45) Date of Patent: Nov. 24, 2026

(54) HANDLE FOR BOXES

(71) Applicant: Persson Innovation AB, Kumla (SE)

(72) Inventor: Kristian Nordgren, Örebro (SE)

(73) Assignee: PERSSON INNOVATION AB, Kumla (SE)

( * ) Notice: Subject to any disclaimer, the term of this patent is extended or adjusted under 35 U.S.C. 154(b) by 221 days.

(21) Appl. No.: 18/574,859

(22) PCT Filed: Jul. 2, 2021

(86) PCT No.: PCT/EP2021/068382
§ 371 (c)(1),
(2) Date: Dec. 28, 2023

(87) PCT Pub. No.: WO2023/274560
PCT Pub. Date: Jan. 5, 2023

(65) Prior Publication Data

US 2024/0327058 A1 Oct. 3, 2024

(51) Int. Cl.
*B65D 5/46* (2006.01)

(52) U.S. Cl.
CPC ..... *B65D 5/46016* (2013.01); *B65D 5/46024* (2013.01)

(58) Field of Classification Search
CPC ..... B65D 5/46016; B65D 5/46024
(Continued)

(56) References Cited

U.S. PATENT DOCUMENTS 2,639,082 A 5/1953 Goldsmith
3,884,411 A * 5/1975 Carlson ..... B65D 5/46016 229/117.26

(Continued)

FOREIGN PATENT DOCUMENTS

CN 203624115 U * 6/2014 ..... B31B 50/86
CN 203845136 U * 9/2014

(Continued)

OTHER PUBLICATIONS

EP 2384886 Machine Translation (Year: 2011).*

(Continued)

*Primary Examiner* — Justin M Larson
(74) *Attorney, Agent, or Firm* — Woodard, Emhardt, Henry, Reeves & Wagner, LLP

(57) ABSTRACT

The present invention relates to a handle (100) for boxes comprising a bottom liner (101); a top liner (102) secured to the bottom liner (101) and comprising a central cut-out portion (103); and a strip (104), wherein the strip (104) comprises a first end portion (105), a second end portion (106) and an elongated central portion (107) which extends between the first end portion (105) and the second end portion (106), wherein the first end portion (105) and the second end portion (106) are secured between the bottom liner (101) and the top liner (102) adjacent opposing ends of the central cut-out portion (103); and the elongated central portion (107) has a length exceeding a length of the cut-out portion (103) and is arranged to form an arch when pulled in a direction away from the bottom liner (101). The strip (104) comprises at least a layer A, a layer B and a layer C, wherein the layer B is arranged between the layer A and the layer C, wherein the layer A comprises nonwoven, the layer B comprises an adhesive, and the layer C comprises a reinforcement material, and wherein the layer A constitutes an exterior surface of the strip (104). This provides a handle with good mechanical properties which is comfortable to grip.

23 Claims, 4 Drawing Sheets

(58) Field of Classification Search
USPC ..... 229/117.24, 117.22
See application file for complete search history.

(56) References Cited

U.S. PATENT DOCUMENTS

| | | | | |
|---|---|---|---|---|
| 2008/0217197 | A1* | 9/2008 | Peters | B65D 5/4208 206/428 |
| 2011/0147444 | A1* | 6/2011 | Fitzwater | B65D 77/062 493/162 |
| 2014/0034543 | A1* | 2/2014 | Grubstein | B65D 75/56 53/461 |
| 2014/0312107 | A1* | 10/2014 | Nash | B31B 50/86 220/768 |
| 2016/0068297 | A1* | 3/2016 | Arki | B65D 5/3642 493/309 |
| 2016/0122075 | A1* | 5/2016 | Spartis | B65B 43/265 53/413 |
| 2019/0023516 | A1* | 1/2019 | Frederick | B65H 16/005 |

FOREIGN PATENT DOCUMENTS

| | | | | | |
|---|---|---|---|---|---|
| DE | 81 27 136 | U1 | | 12/1981 | |
| DE | 31 22 339 | A1 | | 12/1982 | |
| DE | 32 09 220 | A1 | | 9/1983 | |
| EP | 2384886 | A1 | * | 11/2011 | B32B 1/08 |
| EP | 1 780 132 | B1 | | 8/2012 | |
| GB | 995918 | A | * | 6/1965 | |
| JP | 50105155 | U | | 8/1975 | |
| JP | 2014018429 | A | | 2/2014 | |
| JP | 2016011123 | A | | 1/2016 | |
| KR | 20130075833 | A | * | 7/2013 | |

OTHER PUBLICATIONS

International Search Report corresponding to International Patent Application No. PCT/EP2021/068382, mailed Feb. 25, 2022 (4 pages).

* cited by examiner

HANDLE FOR BOXES

FIELD OF THE INVENTION

The present invention relates to a discrete handle for boxes and a method of producing such a handle.

BACKGROUND OF THE INVENTION

Handles are used in a plurality of applications such as for boxes e.g. paper or corrugated board boxes used in retail. Commonly, the handles are glued to boxes to provide a gripable strip which can be gripped by the user allowing the user to lift and move said box.

Handles for boxes must typically be mechanically durable e.g. in terms of load bearing properties and stretchability.

It is known that current handles in the market possess undesirable properties e.g. undesirably low comfort for the user and load bearing capabilities.

Despite advancements made in recent years, there remains a need for improved handles.

SUMMARY OF THE INVENTION

It is an object of the present invention to at least partially overcome problems of the prior art, and to provide a more comfortable and durable handle that is useful in box applications. This and other objects, which will become apparent in the following, are accomplished by a handle for boxes according to a first aspect of the invention, the handle comprising

- a bottom liner;
- a top liner secured to the bottom liner and comprising a central cut-out portion;
- a strip, wherein the strip comprises a first end portion, a second end portion and an elongated central portion which extends between the first end portion and the second end portion, wherein the first end portion and the second end portion are secured between the bottom liner and the top liner adjacent opposing ends of the central cut-out portion; and
- the elongated central portion has a length exceeding a length of the cut-out portion and is arranged to form an arch when pulled in a direction away from the bottom liner;
  - wherein the strip comprises at least a layer A, a layer B and a layer C, wherein the layer B is arranged between the layer A and the layer C, wherein the layer A comprises nonwoven, the layer B comprises an adhesive and the layer C comprises a reinforcement material; and
- wherein the layer A constitutes an exterior surface of the strip.

The inventive handle has proven to be highly promising for attaching to boxes, e.g. boxes used in retail. The present invention is based on the realisation that a handle comprising a strip comprising a nonwoven layer, an adhesive layer and a reinforcement layer exhibits surprisingly high mechanical properties and provides a comfortable strip pleasant to grasp for the user. The present invention is further based on the realisation that the layer structure of the invention combined with the nonwoven layer constituting an exterior surface of the strip provides a handle with surprisingly high mechanical properties while exhibiting a surprisingly high comfort for the user. In addition to providing comfort for the user, the exterior surface of the strip comprising the nonwoven layer further improves the fastening of the strip to the bottom and top liners, as it provides a surface with good fastenability thereto. The invention thereby provides a handle with a high comfort for the end-user, with improved mechanical properties.

It is understood that when the elongated central portion is engaged (pulled in a direction away from the bottom liner) the elongated central portion forms an arch-like shape, a half circle-like shape or substantially any shape at least partially enclosing a void, which void is enclosed by the elongated central portion and the top liner and/or the bottom liner.

It is further understood that the elongated central portion may be compressed or folded on top of the top liner and the bottom liner during e.g. a storage of a plurality handles in a stack or stacking a plurality of boxes where said handles have been attached to said plurality of boxes. This allows for a room efficient storage of e.g. stacks of handles and/or stacks of boxes or the like having handles attached thereto.

In some embodiments, layer B and layer C are arranged as a core and layer A is arranged as a casing substantially covering the core. Arranging the layer B and the layer C as a core provides the strip with good mechanical properties. Arranging the layer A as a casing to substantially cover the core provides the strip with increased mechanical properties and increased ergonomics e.g. improved comfort for the user's hand by providing a soft exterior surface and thereby decreasing the degree the strip presses into the user's hand during use. Preferably, layer A completely covers the core of the strip so as to provide a comfortable surface on the complete strip of the handle. It is understood that two lateral ends of the strip forming a surface that is substantially orthogonal to the longitudinal direction of the strip are not necessarily covered by layer A. Layer A may be arranged as a casing so as to cover at least 80%, such as at least 90% such as at least 95% of the core.

In some embodiments, the strip is folded so as to arrange the layer A as an exterior surface for substantially the whole strip. The strip may be folded at least once, such as at least twice. The strip may be folded at a third of the width of the strip, at a first and a second third of the width of strip, at a fourth of the width of the strip, at a first and a second fourth of the width of strip, and/or at a first, a second and a third fourth of the width of strip. The strip may be folded so as to overlap at the middle of the strip. The strip may be folded twice so as to provide two folds in a longitudinal direction, a first side portion, a second side portion and a centre portion. The first side portion and the second side portion may be folded so as to overlap, for example folded so as to overlap at substantially the middle of the folded strip e.g. in the middle of the centre portion. Thus, the strip is provided with improved comfort as the layer A is arranged as an exterior surface for substantially the whole strip and particularly the two lateral ends of the folded strip. It is understood that the three sections may be of substantially the same or different widths. The first side portion, the second side portion and the centre portion may be secured to each other after folding using an adhesive, e.g. a polyethylene-based adhesive or a hot melt adhesive.

The strip may be folded in the middle of the strip i.e. essentially equidistant from two opposing lateral ends of the strip. The folded strip as described above provides the strip with improved comfort as the layer A is arranged as an exterior surface for substantially the whole strip and thus a user's hand would interact mainly with layer A. Expressed differently, the strip comprising the layer A, the layer B and the layer C may be folded so as to provide a macrostructure of the strip wherein the layers are arranged ABCCBA. It is understood that the fold may constitute a mantle at a first lateral end opposing a second lateral end of the strip in a lengthwise direction as a result of the folding. The layer C may be secured to itself after folding using for example a polyethylene-based adhesive or a hot melt adhesive.

In some embodiments, the adhesive comprises a polyethylene-based adhesive having a weight of from 10 to 50 g/m$^2$. The polyethylene-based adhesive having a weight of from 10 to 50 g/m$^2$ provides a good adhesion between the layers of the strip. Expressed differently, the polyethylene-based adhesive having a weight of from 10 to 50 g/m$^2$ properly and strongly joins the layers of the strip.

In some embodiments, the nonwoven has a weight of from 20 to 100 g/m$^2$. A nonwoven having a weight of from 20 to 100 g/m$^2$ provides the strip of the handle with desired comfort properties as well as contributes to the mechanical stability of the handle.

In some embodiments, the nonwoven is selected from the list consisting of nonwoven polymer, nonwoven jute, nonwoven bamboo and nonwoven textile.

Herein, the term "nonwoven" refers to a material comprising a combination of short and long fibres bonded through chemical, mechanical, heat, and/or solvent treatment. The nonwoven may for example be a nonwoven polymer, a nonwoven jute, a nonwoven bamboo or a nonwoven textile. The nonwoven provides a strip of the handle comfortable for the user to grasp and with good mechanical properties, e.g. tensile strength.

Herein, the term "nonwoven polymer" refers to a nonwoven fabric produced from polymers. A nonwoven produced from polymer material may comprise polyesters, acrylics, nylons, and/or polyolefins.

Herein, the term "nonwoven bamboo" refers to a nonwoven fabric produced from bamboo fibers. A nonwoven bamboo is known to the person skilled in the art.

Herein, the term "nonwoven jute" refers to a nonwoven fabric manufactured from jute fibres and or jute waste. The jute may for exampled be produced by a needle punching process, or any other suitable method known to the person skilled in the art.

Herein, the term "nonwoven textile" refers to nonwoven fabric manufactured from fibers such as wool, cotton or regenerated cellulose.

In some embodiments, the reinforcement material has a weight of from 20 to 200 g/m$^2$. The reinforcement material provides the strip with improved mechanical properties, e.g. strength and durability.

In some embodiments, the reinforcement material is selected from the list consisting of kraft paper, high density polyethylene, jute, paper and textile. In some embodiments, the reinfocement material comprises FibreForm® paper.

Herein, the term "kraft paper" refers to a paper material produced from chemical pulp from the kraft process. Kraft paper is known to the person skilled in the art. The kraft paper can provide the handle with desired mechanical properties.

Herein, the term "high density polyethylene" refers to a polyethylene having a density of from 0.930 to 0.970 g/cm$^3$. High density polyethylene (HDPE) has a high strength-to-density ratio, chemical resistance and thermal stability. HDPE is known to the person skilled in the art.

Herein, the term "paper" refers to a material manufactured from wood pulp or other fibrous substance. The wood pulp may be generated from for example virgin wood chips and/or recycled paper.

Herein, the term "textile" refers to woven fabric comprising e.g. natural fibers e.g. cotton, flax, jute and bamboo and/or regenerated cellulose, animal-derived fibers such as wool or silk, synthetic fibers e.g. polyesters, acrylics, nylons, polyurethans, and/or polyolefins, or a combination thereof. Textile as such as well as additives such as e.g. elastomers, UV absorbers, and frame retardants are known to the person skilled in the art.

Herein, the term "jute" refers to natural bast fibres known to the person skilled in the art.

In some embodiments, the strip has a width of from 5 to 35 mm, such as from 7 to 30 mm, such as from 10 to 25 mm. A strip of the above-mentioned width provides proper mechanical properties as well as comfort for the user. A too slender strip will dig into the hand of the user causing discomfort while a too wide strip will be uncomfortable or practically impossible to grab for the user. It is understood that the above-mentioned width may be the width of a folded or non-folded strip.

In some embodiments, the bottom liner comprises paperboard. A bottom liner comprising paperboard provides the handle with a mechanically rigid base. Further, above-mentioned bottom liner provides a top surface to which a bottom surface of a top liner and/or a strip can be secured. The top surface of the bottom liner may be secured to the bottom surface of the top liner through adhesive means, such as by using a hot melt glue.

In some embodiments, the bottom liner and/or the top liner has a width of from 20 to 90 mm, such as from 30 to 80 mm, such as from 40 to 70 mm. When the handle is in use, e.g. the handle is secured to a box or a parcel, the width of the bottom liner provides a contact surface between the handle and e.g. a box allowing for good adhesion to decrease the risk of unwanted detachment of the handle from the box. The width of the top liner provides a contact surface between the top liner and the bottom liner allowing for good adhesion thus decreasing the risk of unwanted detachment e.g. adhesive or cohesive failure there between.

The term "paperboard" is known to the person skilled in the art and may be single-ply or multi-ply paperboard. The paperboard is one of several factors improving the mechanical properties of the handle.

In some embodiments, the bottom liner has a weight of from 160 to 190 g/m$^2$, such as from 165 to 185 g/m$^2$, such as from 170 to 180 g/m$^2$.

In some embodiments, the top liner comprises a laminated material or a kraft paper. The laminated material may comprise kraft paper.

In some embodiments, the bottom liner has a thickness of from 100 to 500 μm, such as from 150 to 450 μm, such as from 200 to 400 μm.

In some embodiments, the top liner has a thickness of from 200 to 2500 μm, such as from 300 to 2250 μm, such as from 400 to 2000 μm. In an exemplifying embodiment, the top liner is composed of 2-5 layers and each layer has a thickness of from 100 to 500 μm, such as from 130 to 450 μm, such as from 200 to 400 μm. The skilled person will understand from the present disclosure that providing a top layer comprising one layer, or more than 5 layers, is also possible within concept of the present disclosure.

In some embodiments, the strip has a thickness of from 300 to 2500 μm, such as from 500 to 2500 μm, such as from 600 to 2000 μm, such as from 600 to 1200 μm.

In some embodiments, the first end portion and the second end portion of the strip are secured to the bottom liner and the top liner through adhesive means. The adhesive means may for example be an adhesive, such as a polyethylene-based adhesive, such as a polyethylene-based adhesive having a weight of from 10 to 50 g/m$^2$. Securing the strip between the top liner and the bottom liner allows for an improved load distribution and consequently decreases the risk of the strip detaching from the top liner and the bottom liner. This further improves the durability of the handle.

In some embodiments, the handle further comprises a layer D comprising an adhesive; and a layer E comprising a paper-based cover material, wherein the layer D is arranged on top of the layer C and the layer E is arranged on top of the layer D so as to form a stack.

The layer D provides the handle with improved mechanical properties e.g. strength. The layer E provides the handle with improved mechanical properties e.g. strength and improved comfort. The improved comfort provided by the layer E stems from e.g. the stiffness affecting the overall perception of the strip. Further, the paper-based cover material of the layer E allows for aesthetic variations and a printable surface for e.g. branding, date stamps, and indexing. The paper-based cover material provides a surface with good bond forming properties, e.g. wettability, and thus improves adhesive joints and the mechanical properties of the strip.

Herein, the term "paper-based cover material" refers to a material manufactured from wood pulp or other fibrous substance e.g. papers of different qualities. The paper-based cover material may for example be a kraft paper.

In some embodiments, the paper-based cover material has a weight of from 10 to 180 g/m$^2$, such as from 20 to 160 g/m$^2$, such as from 30 to 140 g/m$^2$.

In some embodiments, the layer A is wrapped around layer B and C and optionally layer D and E. Wrapping the layer A around the layer B and C and optionally around layer D and E provides a handle with improved comfort as a user's hand would interact mainly with the layer A during use of the handle, including at the lateral ends of the strip which typically are the parts that may dig in to the hand of the user when gripping the handle, causing discomfort. Providing the layer A of a nonwoven at this portion of the strip is thus particularly advantageous.

According to a second aspect of the invention, there is provided a method for manufacturing a handle as described herein, comprising:

providing a bottom liner;

providing a top liner;

providing a strip;

providing an adhesive;

combining the bottom liner, the top liner, the strip, and the adhesive to form the handle.

In some embodiments, providing a strip comprises providing a layer A, a layer B and a layer C and stacking the layers A-C to form the strip.

In some embodiments, the layer A has a width that is larger than the layer B and the layer C such that after stacking, lateral portions of the layer A extends beyond lateral ends of the layer B and the layer C, and wherein the lateral portions of the layer A are wrapped around the layer B and the layer C, such that layer A provides an exterior surface for substantially the entire strip.

In some embodiments of the method, after stacking, the strip is folded so as to arrange the layer A as an exterior surface for substantially the entire strip.

In some embodiments, providing the strip further comprises providing a layer D and a layer E and stacking the layers A-E, consecutively, to form the strip.

Effects and features of the second aspect are largely analogous to those described above in connection with the first aspect. Embodiments mentioned in relation to the first aspect are largely compatible with the second aspect. It is further noted that the inventive concepts relate to all possible combinations of features unless explicitly stated otherwise.

A further scope of applicability of the present disclosure will become apparent from the detailed description given below. However, it should be understood that the detailed description and specific examples, while indicating preferred embodiments of the disclosure, are given by way of illustration only, since various changes and modifications within the scope of the disclosure will become apparent to those skilled in the art from this detailed description.

Hence, it is to be understood that this disclosure is not limited to the particular component parts of the device described or steps of the methods described as such device and method may vary. It is also to be understood that the terminology used herein is for purpose of describing particular embodiments only and is not intended to be limiting. It must be noted that, as used in the specification and the appended claim, the articles "a", "an", "the", and "said" are intended to mean that there are one or more of the elements unless the context clearly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTION OF THE DRAWINGS

This and other aspects of the present invention will now by way of example be described in more detail, with reference to the appended drawings showing embodiments of the invention, in which.

DETAILED DESCRIPTION OF EMBODIMENTS

The present disclosure will now be described more fully hereinafter with reference to the accompanying drawings, in which currently preferred embodiments of the disclosure are shown. This disclosure may, however, be embodied in many different forms and should not be construed as limited to the embodiments set forth herein; rather, these embodiments are provided for thoroughness and completeness, and to fully convey the scope of the disclosure to the skilled person.

Figure 1A:
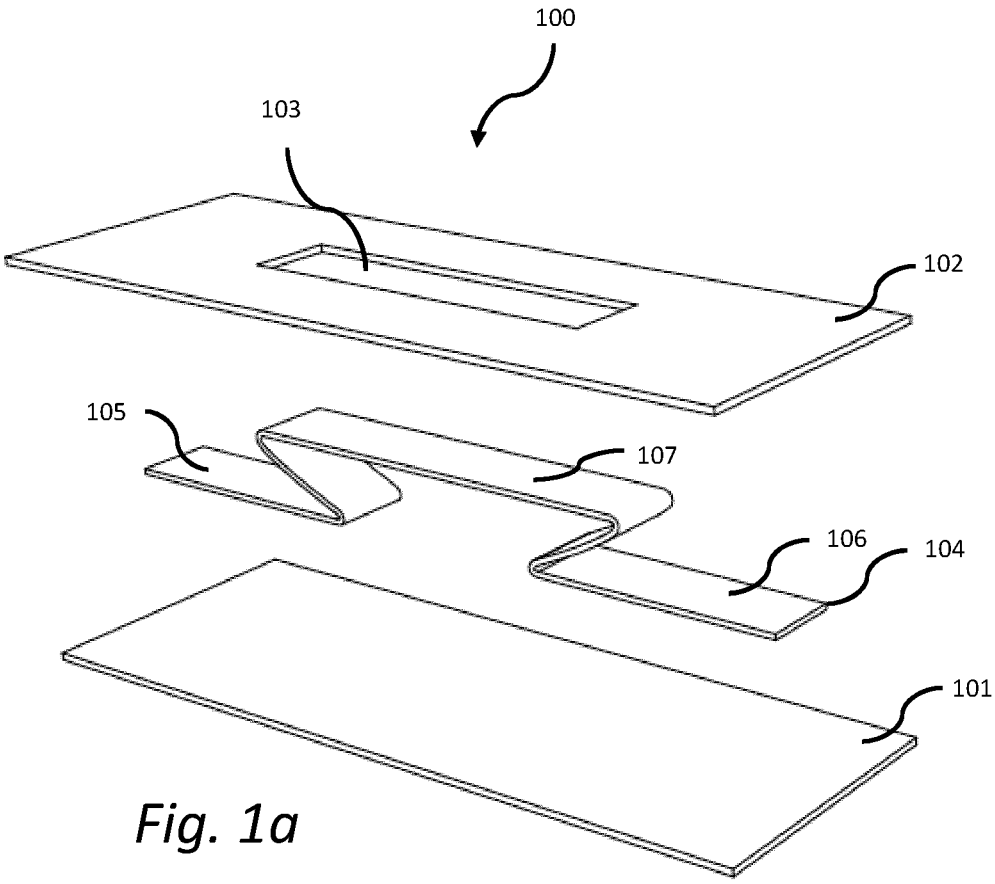
FIG. 1*a* schematically shows an exploded view of the handle according to an embodiment of the invention.
Figure 1B:
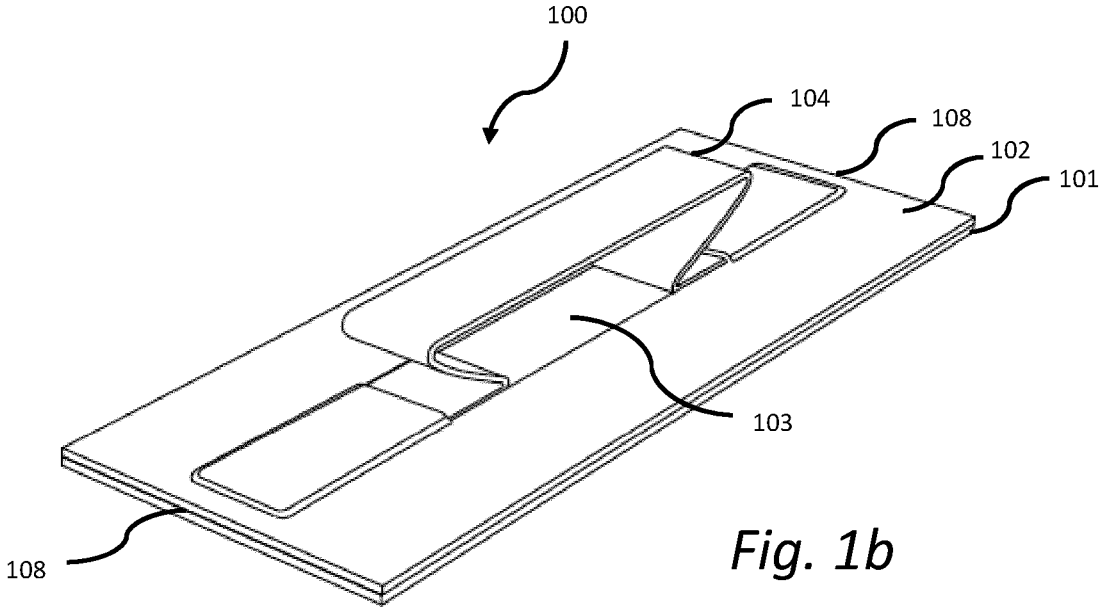
FIGS. 1*b-d* schematically show, from different perspectives, the handle according to an embodiment of the invention.
Figure 1C:
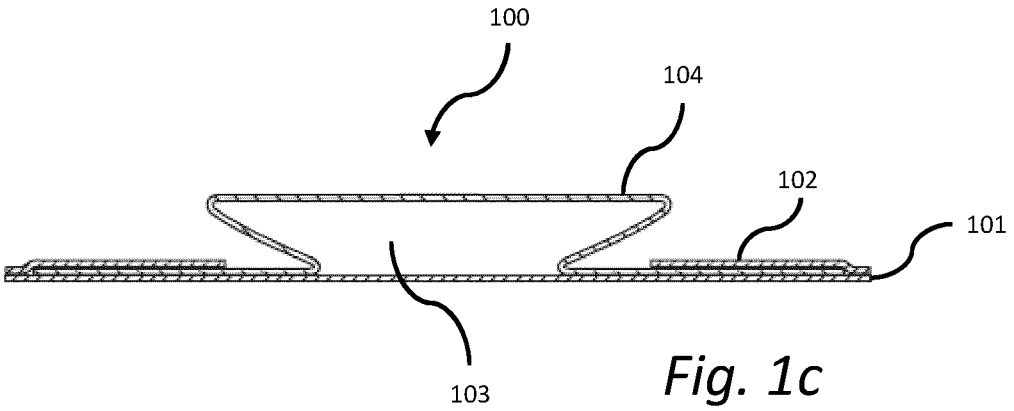
Figure 1D:
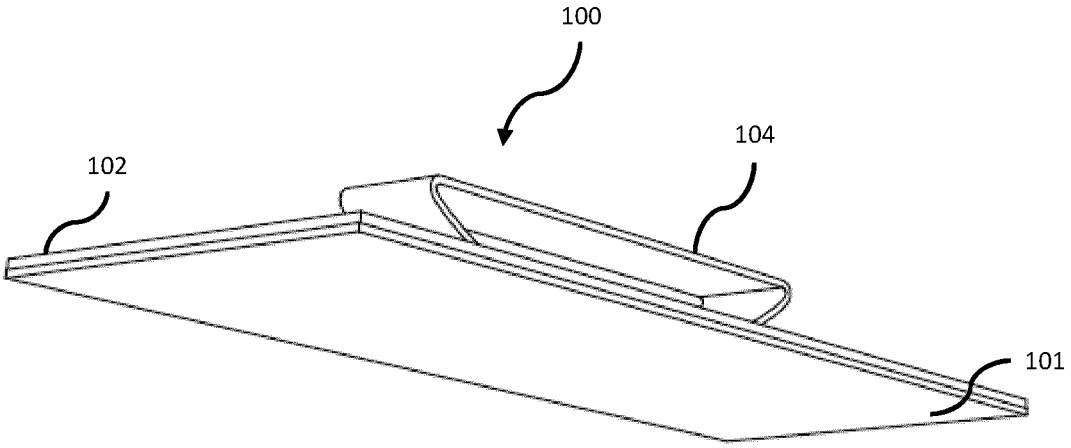

FIG. 1*a* shows an exploded view of a handle 100 according to an embodiment of the present disclosure. FIGS. 1*b-d* show the same handle 100 in a perspective view, a cross-sectional side view, and from below, respectively. The handle 100 comprises a bottom liner 101, a top liner 102 secured to the bottom liner 101 and comprising a central cut-out portion 103, and a strip 104. The strip 104 comprises a first end portion 105, a second end portion 106 and an elongated central portion 107 which extends between the first end portion 105 and the second end portion 106. The first end portion 105 and the second end portion 106 are secured between the bottom liner 101 and the top liner 102 adjacent opposing ends of the central cut-out portion 103, such that the elongated central portion 107 protrudes from the cut-out portion 103 and extends between the opposing ends of the same. The elongated central portion 107 further has a length exceeding a length of the cut-out portion 103 and is arranged to form an arch when pulled in a direction away from the bottom liner 101. The first end portion 105 and the second end portion 106 may each extend between the bottom liner 101 and the top liner 102 from respective opposing ends of the central cut-out portion 103 of the top liner 102 to corresponding lateral ends 108 of the handle 100. The first and second end portions 105, 106 may alternatively extend from respective opposing ends of the central cut-out portion 103 to a distance therefrom which is shorter than the distance between the end of the central cut-out portion 103 and the corresponding lateral end 108 of the handle 100, as shown in FIG. 1*b*.

The first and second end portions 105, 106 of the strip 104 may be secured between the top liner 102 and the bottom liner 101 by simply adhering the top liner 102 to the bottom liner 101 having arranged the first and second end portions 105, 106 of the strip 104 at corresponding portions there between. Alternatively, the first and second end portions 105, 106 may be first secured, e.g. by means of an adhesive, to the bottom liner 101 whereafter the top liner 102 may be secured to the bottom liner 101. In a further alternative, the first and second end portions 105, 106 are first secured, e.g. by means of an adhesive, to the top liner 102, whereafter the top liner 102 may be secured to the bottom liner 101.

Figure 2:
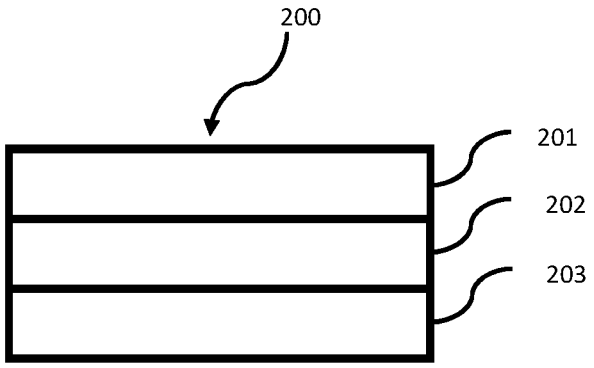
FIG. 2 schematically shows a cross-sectional view of the strip of the handle according to an embodiment of the invention.

The strip 104 comprises at least a layer A, a layer B and a layer C, wherein the layer B is arranged between the layer A and the layer C, as shown in FIG. 2. The structure of the strip will be described in more detail with respect to FIGS. 2-4.

The top liner 102 may comprise a laminated material or a kraft paper.

The bottom liner 101 may comprise paperboard.

The bottom liner 101 may have a thickness of from 100 to 500 μm, such as from 150 to 450 μm, such as from 200 to 400 μm.

The top liner 102 may have a thickness of from 200 to 2500 μm, such as from 300 to 2250 μm, such as from 200 to 2000 μm.

The strip 104 may have thickness of from 300 to 2500 μm, such as from 500 to 2500 μm, such as from 600 to 2000 μm, such as from 600 to 1200 μm.

FIG. 2 shows, in cross-section, a strip 200 of a handle according to an embodiment of the invention. The strip 200 comprises a layer A 201, a layer B 202 and a layer C 203. The layer B is sandwiched between the layer A and the layer C. The layer A 201 may comprise nonwoven, the layer B 202 may comprise an adhesive and the layer C 203 may comprise a reinforcement material.

The nonwoven of layer A 201 may be of a nonwoven polymer, nonwoven jute, nonwoven bamboo and nonwoven textile. The nonwoven of layer A may have a weight of from 20 to 100 g/m$^2$.

The adhesive of layer B 202 may be a polyethylene-based adhesive, such as a polyethylene-based adhesive having a weight of from 10 to 50 g/m$^2$.

The reinforcement material of layer C 203 may be selected from the list consisting of kraft paper, high density polyethylene, jute, paper and textile. The reinforcement material of layer C 203 may have a weight of from 20 to 200 g/m$^2$.

The strip 200 may have a width of from 5 to 35 mm, such as from 7 to 30 mm, such as from 10 to 25 mm.

Figure 3:
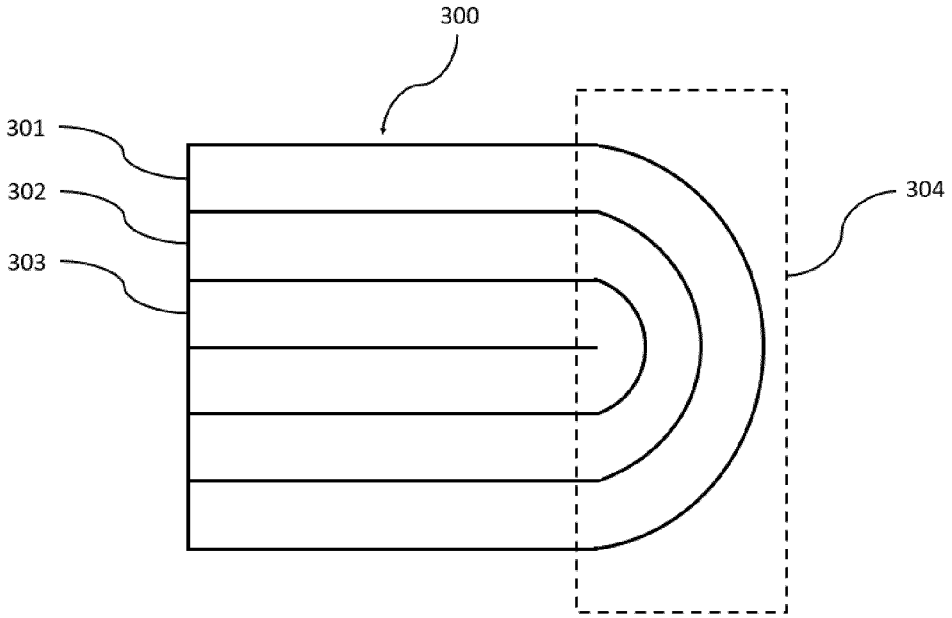
FIG. 3 schematically shows a cross-sectional view of a folded strip of the handle according to an embodiment of the invention.

FIG. 3 depicts, in cross-section, a folded strip 300 of the handle according to an embodiment of the invention. The strip comprises a layer A 301, a layer B 302 and a layer C 303. The layer B is sandwiched between the layer A and the layer C. The layer A 301 may comprise nonwoven, the layer B 302 may comprise an adhesive and the layer C 303 may comprise a reinforcement material. The strip 300 comprises a fold 304 constituting a mantle in a lengthwise direction as a result of the folding. The skilled person understands that the dashed line of FIG. 3 merely serves as a tool highlighting the fold of the handle, and that the dashed line is in fact not a part or feature of the strip 300 of the handle of the invention.

The strip 300 is folded so as to arrange the layer A 301 as an exterior surface for substantially the whole strip 300. The strip 300 may be folded in a longitudinal direction. The strip 300 is, according to the exemplifying embodiment shown in FIG. 3, folded in the middle of the strip i.e. essentially equidistant from two opposing lateral ends of the strip. The strip 300 may, however, also be folded at least once, such as at least twice. The strip 300 may be folded at a third of the width of the strip, at a first and a second third of the width of strip, at a fourth of the width of the strip, at a first and a second fourth of the width of strip, and/or at a first, a second and a third fourth of the width of strip. The strip 300 may be folded so as to overlap at the middle of the strip 300. The strip 300 may be folded so as to provide two folds in a longitudinal direction, forming a first side portion, a second side portion and a centre portion. The first side portion and the second side portion may be folded so as to overlap, for example folded so as to overlap at substantially the middle of the folded strip e.g. in the middle of the centre portion. It is understood that the three sections may be of substantially same or different widths. The first side portion, the second side portion and the centre portion may be secured to each other after folding using for example a polyethylene-based adhesive.

The folded strip 300 may have a width of from 5 to 35 mm, such as from 7 to 30 mm, such as from 10 to 25 mm.

The nonwoven of layer A 301 may be of a nonwoven polymer, nonwoven jute, nonwoven bamboo and nonwoven textile. The nonwoven of layer A may have a weight of from 20 to 100 g/m$^2$.

The adhesive of layer B 302 may be a polyethylene-based adhesive, such as a polyethylene-based adhesive having a weight of from 10 to 50 g/m$^2$.

The reinforcement material of layer C 303 may be selected from the list consisting of kraft paper, high density polyethylene, jute, paper, and textile. The reinforcement material of layer C 303 may have a weight of from 20 to 200 g/m$^2$.

Figure 4:
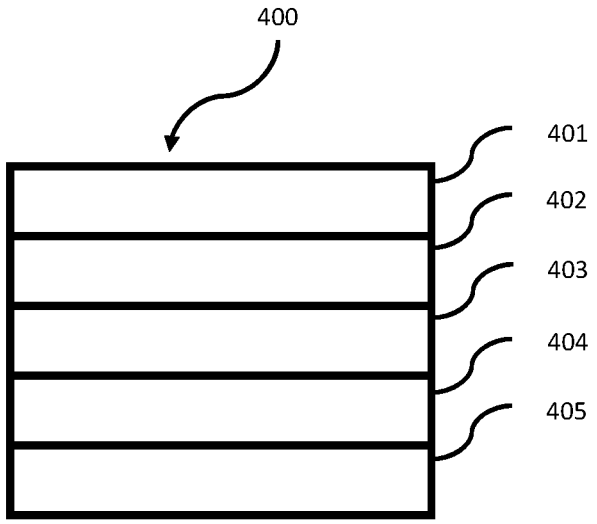
FIG. 4 schematically shows a cross-sectional view of the strip of the handle according to another embodiment of the invention.

FIG. 4 shows, in cross-section, a strip 400 of the handle 100 according to an embodiment of the invention. The strip comprises a layer A 401, a layer B 402, a layer C 403, a layer D 404 and a layer E 405. The layers A-E are stacked consecutively to form the strip.

The layer A 401 may comprise nonwoven, the layer B 402 may comprise an adhesive, the layer C 403 may comprise a reinforcement material, the layer D 404 may comprise an adhesive, and the layer E 405 may comprise a paper-based cover material or a kraft paper.

The nonwoven of layer A 401 may be of a nonwoven polymer, nonwoven jute, nonwoven bamboo and nonwoven textile. The nonwoven of layer A may have a weight of from 20 to 100 g/m$^2$.

The adhesive of layer B 402 may be a polyethylene-based adhesive, such as a polyethylene-based adhesive having a weight of from 10 to 50 g/m$^2$.

The reinforcement material of layer C 403 may be selected from the list consisting of kraft paper, high density polyethylene, jute, paper, and textile. The reinforcement material of layer C 403 may have a weight of from 20 to 200 g/m$^2$.

The strip 400 may in some embodiments be folded as described with reference to FIG. 3, to provide the layer A 401 as an exterior surface of substantially the entire strip 400.

The strip 400 may have a width of from 5 to 35 mm, such as from 7 to 30 mm, such as from 10 to 25 mm.

Figure 5:
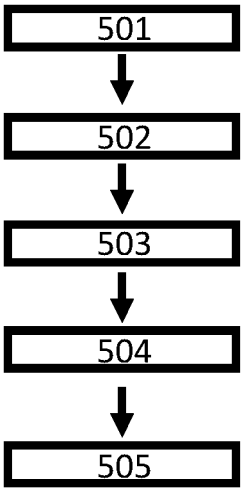
FIG. 5 shows a flow-sheet of the steps of a method in accordance with an embodiment of the invention.

FIG. 5 shows a flow-sheet over different steps of a method 500 for manufacturing the handle disclosed herein. The method 500 comprises: providing 501 a bottom liner; providing 202 a top liner; providing 503 a strip; providing 504 an adhesive; and combining 505 the bottom liner, the top liner, the strip, and the adhesive to form the handle.

The method 500 may further comprise providing a layer A, a layer B and a layer C and stacking the layers to form the strip.

The provided layer A may have a width that is larger than the layer B and the layer C such that after stacking, lateral portions of the layer A extends beyond lateral ends of the layer B and the layer C, and wherein the lateral portions of the layer A are wrapped around the layer B and the layer C, such that layer A provides an exterior surface for substantially the entire strip.

The method 500 may comprise, after stacking folding the strip so as to arrange the layer A as an exterior surface for substantially the entire strip.

The method 500 may further comprise providing a layer D and a layer E, and stacking the layers A-E, consecutively, to form the strip.

EXAMPLES

Materials and Manufacture

An embodiment of the inventive handle IH1 was manufactured comprising a strip having a layer A comprising a nonwoven, a layer B comprising a polyethylene adhesive and a layer C comprising a FibreForm® paper. The strip was folded so that layer A constitutes an exterior surface of the strip. The structure of the strip of IH1 is presented in table 1.

Comparative handles CH1, CH2 were manufactured. The structure of the strip of the comparative handles CH1, CH2 are presented in table 1.

The inventive handle IH1 as well as the comparative handles CH1, CH2 has a handle structure as described herein, with top and bottom liners between which the first and the second end portions of the strip are secured.

TABLE 1

Structure and thickness of the tested strips

| Sample | Strip structure | Strip width |
|---|---|---|
| IH1 | 3 layers, folded arrangement:<br>Layer A: nonwoven<br>Layer B: PE adhesive<br>Layer C: FiberForm ® paper | 16 mm |
| CH1 | 5 layers wherein outermost layer comprises kraft paper | 16 mm |
| CH2 | Corresponds to IH1 without layer A | 16 mm |

Evaluation of Handles

An embodiment of the inventive handle IH1 was compared in a load bearing test to the comparative handles CH1 and CH2. The results of the load bearing evaluation are shown in table 2. Consequently, the inventors have surprisingly found that the inventive handles show a higher load bearing capacity as compared to the comparative handles.

The load bearing test was conducted by arranging a handle on a surface and securely fastening said handle between the surface and a plate comprising an opening so that the strip of the handle is accessibly arranged in the opening of the plate. Expressed differently, the plate is arranged so as to fixate the handle to the surface by applying pressure on the top liner and the bottom liner of the handle using the plate. The strip is then pulled substantially orthogonally away from the top and bottom liner using a holder designed to replicate the shape and width of a human hand until the strip reaches failure i.e. until the strip breaks and thusly the maximum load bearing capacity is identified.

TABLE 2

Load bearing capacity of the tested strips.

| Sample | Load bearing capacity [kilograms] |
|---|---|
| IH1 | 115 |
| CH1 | 50 |
| CH2 | 40 |

While the invention has been illustrated and described in detail in the drawings and foregoing description, such illustration and description are to be considered illustrative or exemplary and not restrictive. The invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A handle for boxes comprising a bottom liner;

a top liner secured to the bottom liner and comprising a central cut-out portion; and a strip, wherein the strip comprises a first end portion, a second end portion and an elongated central portion which extends between the first end portion and the second end portion, wherein the first end portion and the second end portion are secured between the bottom liner and the top liner adjacent opposing ends of the central cut-out portion, and the elongated central portion has a length exceeding a length of the cut-out portion and is arranged to form an arch when pulled in a direction away from the bottom liner, wherein the strip comprises at least a layer A, a layer B and a layer C, wherein the layer B is arranged between the layer A and the layer C to define a stack, and wherein the stack is folded so that layer A is an exterior surface of the strip; and wherein the layer A comprises nonwoven, the layer B comprises an adhesive and the layer C comprises a reinforcement material.

2. The handle according to claim 1, wherein the adhesive comprises a polyethylene-based adhesive having a weight of from 10 to 50 g/m$^2$.

3. The handle according to claim 1, wherein the nonwoven has a weight of from 20 to 100 g/m$^2$.

4. The handle according to claim 1, wherein the nonwoven is selected from the list consisting of nonwoven polymer, nonwoven jute, nonwoven bamboo and nonwoven textile.

5. The handle according to claim 1, wherein the reinforcement material has a weight of from 20 to 200 g/m$^2$.

6. The handle according to claim 1, wherein the reinforcement material is selected from the list consisting of kraft paper, high density polyethylene, jute, paper and textile.

7. The handle according to claim 1, wherein the strip has a width of from 5 to 35 mm.

8. The handle according to claim 1, wherein the strip is configured to have a breaking strength of at least 100 kg as evaluated by means of the test described in the detailed description.

9. The handle according to claim 1, wherein the bottom liner comprises paperboard.

10. The handle according to claim 1, wherein the bottom liner has a weight of from 160 to 190 g/m$^2$.

11. The handle according to claim 1, wherein the first end portion and the second end portion of the strip are secured to the bottom liner and the top liner through adhesive means.

12. The handle according to claim 1, wherein the layer A is wrapped around at least layers B and C.

13. The handle according to claim 1, wherein the bottom liner and/or the top liner has a width of from 20 to 90 mm.

14. The handle according to claim 1, wherein the top liner comprises a laminate or a kraft paper.

15. The handle according to claim 1, wherein layer A is the exterior surface for substantially the entire strip.

16. The handle according to claim 1, further comprising a layer D comprising an adhesive; and a layer E comprising a paper-based cover material, wherein the layer D is arranged on top of the layer C and the layer E is arranged on top of the layer D so as to form the stack.

17. The handle according to claim 16, wherein the paper-based cover material has a weight of from 30 to 140 g/m$^2$.

18. A method for manufacturing a handle according to claim 1, comprising:

providing the bottom liner;

providing the top liner;

providing the strip;

providing an adhesive;

combining the bottom liner, the top liner, the strip, and the adhesive to form the handle.

19. The method according to claim 18, wherein providing the strip further comprises providing a layer D and a layer E and stacking the layers A-E.

20. The method according to claim 18, wherein providing the strip comprises providing the layer A, the layer B and the layer C and stacking the layers A-C.

21. The method according to claim 20, wherein after stacking, the stack is folded so as to arrange the layer A as an exterior surface for substantially the entire strip.

22. A handle for boxes comprising a bottom liner;

a top liner secured to the bottom liner and comprising a central cut-out portion; and a strip, wherein the strip comprises a first end portion, a second end portion and an elongated central portion which extends between the first end portion and the second end portion, wherein the first end portion and the second end portion are secured between the bottom liner and the top liner adjacent opposing ends of the central cut-out portion, and the elongated central portion has a length exceeding a length of the cut-out portion and is arranged to form an arch when pulled in a direction away from the bottom liner, wherein the strip comprises at least a layer A, a layer B and a layer C, a layer D, and a layer E;

wherein the layer B is arranged between the layer A and the layer C, wherein the layer D is arranged on top of the layer C and the layer E is arranged on top of the layer D so as to form a stack;

wherein the layer A comprises nonwoven, the layer B comprises an adhesive, the layer C comprises a reinforcement material, the layer D comprises an adhesive, and the layer E comprises a paper-based cover material;

wherein the layer A constitutes an exterior surface of the strip; and wherein layer B and layer C are arranged as a core and layer A is arranged as a casing substantially covering the core.

23. The handle according to claim 22, wherein the paper-based cover material has a weight of from 30 to 140 g/m$^2$.

* * * * *